United States Patent [19]

Kuchem

[11] Patent Number: 4,765,102

[45] Date of Patent: Aug. 23, 1988

[54] BUILDING PANEL SUPPORT MEMBER WITH BUILT-IN ILLUMINATION MEANS

[76] Inventor: Christopher L. Kuchem, 4501 W. 76th, Prairie Village, Kans. 66208

[21] Appl. No.: 16,927

[22] Filed: Feb. 20, 1987

[51] Int. Cl.[4] ..... E04H 14/00; E04B 5/37; E04B 7/02

[52] U.S. Cl. ..... 52/28; 52/36; 52/90; 47/17; 362/147; 362/396

[58] Field of Search ..... 52/28, 36, 90, 235; 362/145, 147, 32, 396, 806, 217; 47/17

[56] References Cited

U.S. PATENT DOCUMENTS

| | | | |
|---|---|---|---|
| 1,502,353 | 7/1924 | Simonson | 52/28 |
| 1,756,849 | 4/1930 | Braastad | 52/28 X |
| 2,327,396 | 8/1943 | Boardman | 362/396 X |
| 3,226,907 | 1/1966 | Gregoire | 52/28 X |
| 3,267,275 | 8/1966 | Kendall et al. | 362/396 X |
| 3,721,050 | 3/1973 | Perina | 52/28 |
| 3,971,172 | 7/1976 | Gentil | 52/28 |
| 4,120,024 | 10/1978 | Aizenberg et al. | 362/147 X |
| 4,471,586 | 9/1984 | Shuch et al. | 52/36 |
| 4,601,139 | 7/1986 | Esposito | 52/90 |

*Primary Examiner*—David A. Scherbel
*Assistant Examiner*—Richard E. Chilcot, Jr.
*Attorney, Agent, or Firm*—Kokjer, Kircher, Bradley, Wharton, Bowman & Johnson

[57] ABSTRACT

A structural aluminum extrusion which supports glass, plastic or other building panels and is also specially formed to house a lighting system. The panels are clamped edge to edge on one edge portion of the extrusion and a channel is formed in the opposite edge portion. The channel houses an elongate glass tube filled with neon. A special clip inserted in the channel holds the tube and the high voltage wire which supplies power to the tube. A snap on diffuser lens covers the channel and encloses the components of the lighting system.

13 Claims, 1 Drawing Sheet

BUILDING PANEL SUPPORT MEMBER WITH BUILT-IN ILLUMINATION MEANS

BACKGROUND OF THE INVENTION

This invention relates to a beam or other panel supporting member which is specially constructed in a manner to accommodate built in lighting.

In recent years, solaria, large sky lights, glass canopies and arches, curtain walls, and other transparent structures have achieved growing architectural popularity. For example, it has recently become common practice for glass solaria to either be added on to existing commercial and residential buildings or built into newly constructed buildings. Sun rooms have been particularly popular in restaurants because they have considerable appeal to customers. Arch barrel walkways which are covered by curved transparent panels have also enjoyed considerable recent popularity.

Structures of this type normally include a number of glass or transparent plastic panels which are connected edge to edge by beams or other structural members which form the supporting framework of the structure. In commercial buildings, the structural members are often aluminum extrusions which take the form of rectangular tubes. The edges of adjacent panels are clamped or otherwise secured to and supported by the extrusions. The extrusions are arranged in a framework as rafters, wall studs or, in the case of arched walkways, as curved arches.

One of the major problems associated with this type of construction is the provision of lighting which is both functionally and aesthetically acceptable. Suspended lights or track lighting is often used, and difficulty is encountered in installing the light fixtures, hardware and wiring. Perhaps even more importantly, the light system creates a cluttered appearance which detracts appreciably from the aesthetic appeal of the overall structure.

SUMMARY OF THE INVENTION

The present invention is directed to a rigid structural member which is specially formed to provide both structural support for building panels and built in lighting capability. It is a particularly important feature of the invention that the lighting system is contained wholly within a channel which is formed in one edge portion of the structural member, thus avoiding clutter which could detract from the aesthetics of the structure. In addition, the lighting system is both functional and attractive in that it provides a continuous ribbon of light which exactly follows the contour of the structure (i.e., the ribbon of light curves along an arch member or extends straight along a straight rafter or wall stud). The light tube, all wiring, and all hardware are housed within a compartment which is closed off by an attractive diffuser lens, thus providing a clean and attractive appearance. At the same time, installation and maintenance can be quickly and easily carried out.

DETAILED DESCRIPTION OF THE INVENTION

In the accompanying drawing which forms a part of the specification and is to be read in conjunction therewith and in which like reference numerals are used to indicate like parts in the various views.

Figure 1:
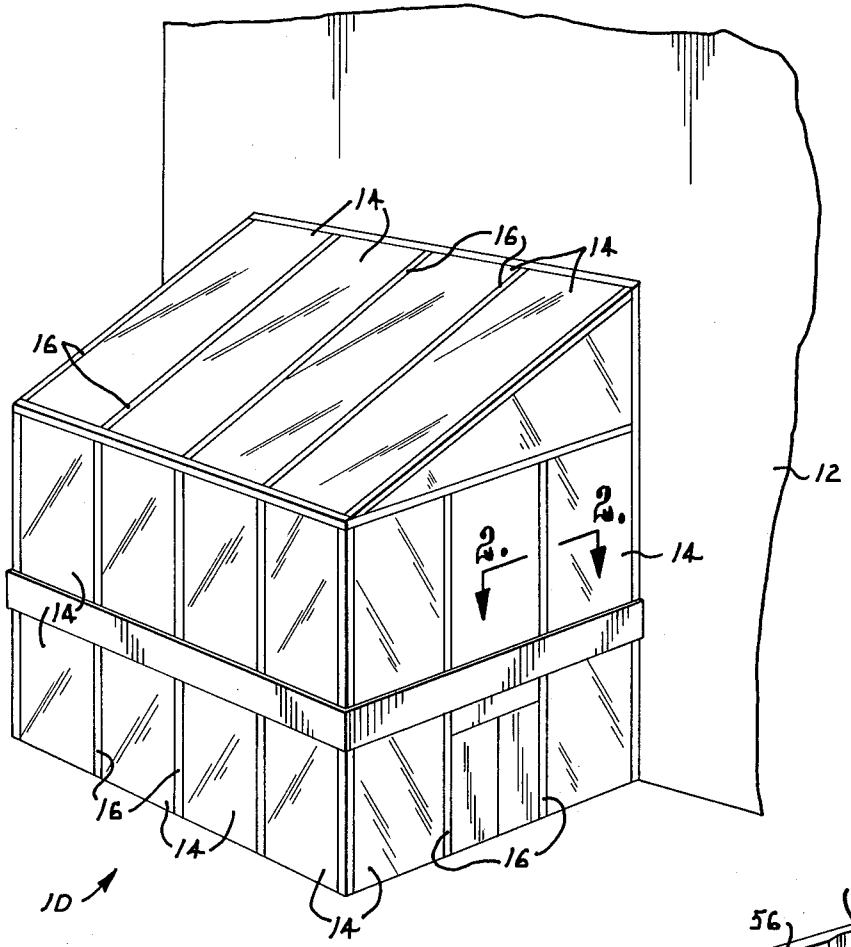
FIG. 1 is a perspective view of a solarium of the type which may employ structural members constructed according to the present invention.

Referring now to the drawing in more detail and initially to FIG. 1, numeral 10 generally designates a solarium which is attached to a vertical wall 12 of a building. The solarium 10 may be added onto an existing building or built as part of a newly constructed building. In any event, the room defined within the solarium 10 is enclosed by a plurality of glass panels 14 which form the walls and roof of the solarium. The panels 14 on the walls and roof are connected to one another edge to edge by rigid structural members 16 which form both the vertical wall studs and the inclined rafters of the solarium.

Figure 2:
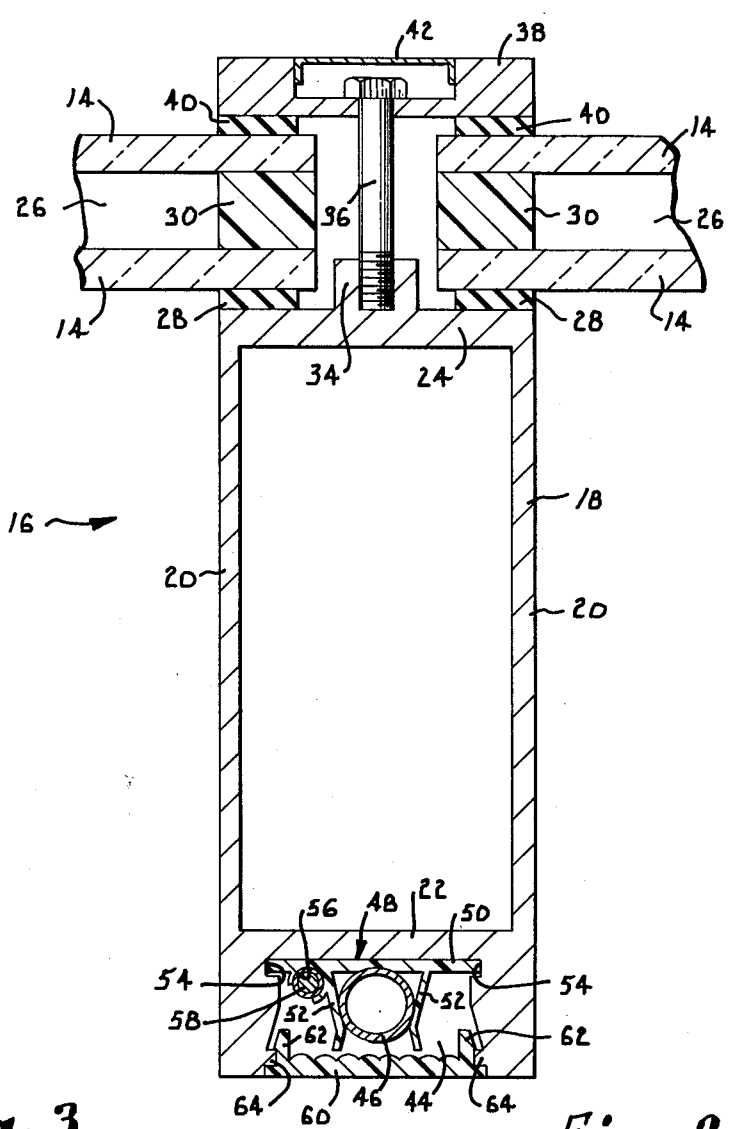
FIG. 2 is a fragmentary sectional view on an enlarged scale taken generally along line 2—2 of FIG. 1 in the direction of the arrows.

Referring now more particularly to FIG. 2, each of the structural members 16 is constructed in a similar manner and connects with the panels it supports in the same manner as the other structural members. Each structural member takes the form of an elongated aluminum extrusion 18 which may be a hollow rectangular tube. Each extrusion 18 is extruded into the desired shape and is cut to the required length. It should be noted that the extrusions may be straight members as shown in FIG. 1 or, in the case of covered canopies or barrel walkways, the extrusions may be arch shaped or they may take on another curved shape.

Each extrusion 18 has opposite side walls 20 and inner and outer walls 22 and 24 on its inside and outside edges, respectively. The transparent panels 14 are secured to the outer edge of each extrusion.

In the insulated, double glazed arrangement shown in FIG. 2, the panels 14 are provided in parallel pairs which are spaced apart from one another to provide a "dead space" between each pair of panels. It should be noted that the present invention is applicable to a single glazed system as well as to the double glazed system shown and described herein. At each extrusion in the double glazed arrangement, the panels in each pair are connected generally edge to edge with the panels in the adjacent pair. The edges of the inside panels 14 are received on pads 28 which engage the outer surface of wall 24. The edge portion of each outer panel is spaced outwardly from the edge portion of each inner panel by a spacer 30 which is interposed between the panel edges.

A plurality of internally threaded bosses 34 are formed integrally on the outer wall 24 of extrusion 18. A bolt 36 extends through a rigid retainer plate 38 and is threaded into each boss 34. The bolt head is received in a cavity formed in the retainer plate 38 which overlies a pair of pads 40 which fit against the edge portions of the outer panels 14. When the bolts 36 are tightened, the retainer plate 38 clamps pads 28 and 40 against the panels 14, with the spacers 30 sandwiched between the edges of the panels in the double glazed arrangement. In this manner, panels 14 are secured to and supported generally edge to edge on the structural member 16. A cover 42 may be secured to the retainer plate 38 in order to enclose the cavity and cover the bolt heads contained therein. The single glazed system is similar but lacks the second set of panels and the spacers 30.

In accordance with the present invention, the inner edge portion of one or more of the extrusions 18 may be provided with a channel 44 which opens inwardly and extends along the entire length of the extrusion 18. The channel 44 provides a recess in which a neon filled glass tube 46 may be contained and enclosed. The glass tube 46 is an elongated hollow tube held in place in channel 44 by a plurality of clips which are generally identified by numeral 48.

Figure 3:
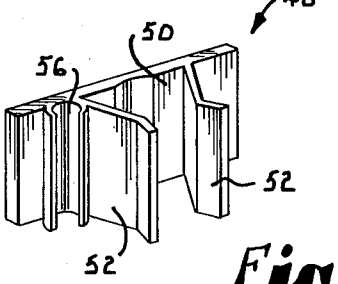
FIG. 3 is an enlarged perspective view of a clip member which is used to hold the light tube in place within the channel of the structural member.

The configuration of each clip 48 is best illustrated in FIG. 3. Each clip includes a generally flat base plate 50 from which a pair of spaced apart legs 52 extend. The clips 48 are preferably constructed in a single piece and may be molded plastic. The legs 52 are flexible enough to be spread apart slightly to permit entry of tube 46 between them, and the legs resist their outward displacement and grip firmly against the opposite sides of the inserted tube. In this manner, tube 46 is held rigidly in place between the legs 52 of each clip, although the tube can be removed when it is necessary to replace or service it.

The opposite side edges of plate 50 fit closely within grooves 54 which are formed in extrusion 18 on opposite sides of the channel 44 adjacent to its closed end. The close fit of the plate edges in grooves 54 holds the clips securely in place within the channel.

Also formed on each clip 48 is a generally C-shaped channel 56 having its open side accessible for insertion and removal of a high voltage electrical wire 58 which fits closely within channel 56. The high voltage wire 58 is an insulated conductor which extends from one end of the elongated glass tube 46 to a transformer (not shown) located at the opposite end of the tube in the usual manner. The close fit of the wire 58 in channel 56 holds the wire securely in place and yet at the same time provides ready access to the wire and permits it to be removed for inspection and/or replacement.

The open side of channel 44 is covered by an extruded plastic diffuser lens 60 which serves to diffuse and evenly spread the light that is emitted by the neon tube 46. The exposed face of lens 60 is generally flat and is flush with the adjacent surfaces of wall 22 of the extrusion. A pair of lugs 62 extend from lens 60 into the channel 44 and are hooked in a snap fit with a pair of small ribs 64 which present shoulders which are engaged by the lugs 62. The lugs are hooked on the shoulders of ribs 64 in order to securely hold the lens 60 in place covering channel 44, thereby enclosing therein the neon tube 46, the clips 48 and the high voltage electrical wire 58.

The specially constructed extrusion 18 functions both as a structural member for supporting the panels 14 and as a housing for the lighting system. Structural members which are selected to provide lighting are constructed in the manner shown in FIG. 2, and the other structural members may have a conventional construction or may have the same construction and have their channels 44 covered by a suitable cover plate (not shown). The structural members which provide lighting may be on the ceiling, the walls or virtually any other desired location. However, the lighting is most often provided overhead in sun rooms, and the rafters or ceiling joists are thus most often constructed to provide the built in lighting.

When the neon tube 46 is energized by applying electrical current, it emits light which is diffused and evenly spread by the lens 60. Tube 46 and lens 60 extend continuously along the entire length of the structural member 16, and a continuous ribbon of light is thus provided along the structural member by the lighting system. The light emitted by the lighting system is functional in that it provides the light necessary for activities carried on within the solarium, and it is also highly decorative in that the ribbon of light extends continuously along and exactly follows the shape of the structural member.

It is again pointed out that the structural member 16 may be a straight member as shown for the rafters and wall studs in FIG. 1, or it may be an arch shaped member or a member which is curved or bent in virtually any other shape. The neon tube 46 can easily be made to follow the same contour as the structural member to which it is attached. As a consequence, the lighting system conforms exactly to the shape of the structure in which it is used. It should be noted that the panels supported by the extrusions are curved panels in the case of an arched canopy or other curved structure. It should also be noted that the panels need not be transparent and can be building panels of virtually any type. In addition, the panels can be connected to the extrusions by means other than the specific conventional arrangement disclosed herein.

The light system can be used to provide exterior lighting as well as interior lighting. A neon light tube is preferred because neon lights burn cool. It is possible in some applications for a florescent light tube to be used, although florescent lighting burns hot and is normally not as desirable as neon lighting for the majority of the applications contemplated by this invention.

It is particularly important that the light tube 46 and all hardware and wiring are housed wholly within the enclosed channel 44 which is formed in the extrusion 18. A clean and attractive appearance is thus maintained because the wiring and hardware is out of view. As a result, the lighting system of the present invention provides an uncluttered appearance in contrast to the suspended lights and track lighting which have typically been used in the past for similar applications.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In an architectural frame construction for holding adjacent edges of building panels, the improvement comprising:

an elongate rigid structural member having opposite edge portions;

means for connecting the adjacent edges of a pair of the panels to said structural member;

an elongate channel in one edge portion of said structural member, said channel extending lengthwise along the structural member;

an elongate light tube operable to emit light when energized, said tube having a size to fit in said channel and to conform with the shape of the channel; and means for mounting said light tube in said channel to extend along at least a substantial part of the length of said structural member, whereby said tube upon energization emits a ribbon of light from said structural member in extension lengthwise thereon, said mounting means comprising a clip having a plate portion secured in said channel and a pair of spaced apart legs between which said light tube is retained and a channel extending on said clip and having a size to closely receive an electrical conductor for supplying power to said tube.

2. The improvement of claim 1, including a lens on said structural member, said lens covering said channel and diffusing the light emitted from said light tube.

3. The improvement of claim 1, including a pair of grooves in said structural member adjacent the channel on opposite sides thereof, said plate portion of the clip having opposite side edges received in said grooves to secure the clip in the channel.

4. The improvement of claim 1, including:

a diffuser lens for covering said channel, said lens having a pair of legs projecting therefrom, and a pair of shoulders on said structural member at locations within said channel, said legs being engageable with said shoulders in a snap fit to retain said lens on the structural member at a location to cover the channel.

5. In a building having a plurality of building panels connected generally edge to edge, a support arrangement for the panels comprising:

an elongate metal building beam having a hollow interior and a generally rectangular shape in section and presenting an inner edge portion and an outer edge portion;

means for connecting a pair of the panels generally edge to edge to said beam adjacent the outer edge portion thereof;

a channel in said beam extending along the length of the inner edge portion thereof and having an open side opening into the building and an opaque closed side separating the channel from the interior of the beam;

an elongate light tube operable to emit light when energized, said tube being housed in said channel in extension along the length thereof to emit a continuous ribbon of light from the beam when energized;

means for mounting said light tube in said channel; and a light diffusing lens covering the open side of said channel.

6. The invention of claim 5, wherein said mounting means comprises clip means for holding said light tube in the channel.

7. The invention of claim 6, wherein said clip means comprises:

a clip having a plate portion and a pair of legs projecting from said plate portion at locations to grip said light tube therebetween; and means for securing said clip in said channel with said legs located and oriented to accept entry of said tube therebeteween.

8. The invention of claim 7, wherein said securing means comprises a pair of grooves in said beam on opposite sides of the channel, said grooves having sizes and locations to receive opposite side edges of said plate portion of the clip therein to hold the clip in the channel.

9. The invention of claim 7, including a channel on said clip at a location to receive and hold an electrical conductor for supplying power to said light tube.

10. The invention of claim 5, including:

means for providing a pair of shoulders on said beam at locations within said channel; and a pair of lugs projecting from said lens and being applicable to said shoulders in a snap fit therewith to hold said lens on the beam at a location covering the open side of said channel.

11. An architectural extrusion comprising:

an extruded structural member having an elongate configuration and a generally rectangular shape in section, said structural member being rigid and hollow and having opposite first and second edge portions;

means for connecting a pair of building panels generally edge to edge to said first edge portion of the structural member;

said second edge portion of the structural member having an open channel extending along the length thereof;

a neon filled glass tube operable to emit light when energized, said tube fitting in said channel in extension continuously along the entire length thereof;

clip means for holding said tube in the channel, said clip means comprising a clip having a plate portion secured in said channel and a pair of spaced apart legs between which said light is retained, and a channel extending on said clip and having a size to closely receive an electrical conductor for supplying power to said tube; and a lens mounted on said structural member at a location to cover said channel, said lens diffusing the light emitted from said tube.

12. The extrusion of claim 11, including a pair of grooves in said structural member adjacent the channel on opposite sides thereof, said plate portion of the clip having opposite side edges received in said grooves to secure the clip in the channel.

13. The extrusion of claim 11, including:

means for providing a pair of shoulders on said structural member at locations within said channel; and a pair of legs projecting from said lens and being applicable to said shoulders in a snap fit therewith to hold said lens on the structural member at a location covering the channel.

* * * * *